US006502902B1

(12) United States Patent
Romero

(10) Patent No.: US 6,502,902 B1
(45) Date of Patent: Jan. 7, 2003

(54) STADIUM SEAT

(76) Inventor: Kardel Romero, 713 Angers St., New Iberia, LA (US) 70563

( * ) Notice: Subject to any disclaimer, the term of this patent is extended or adjusted under 35 U.S.C. 154(b) by 0 days.

(21) Appl. No.: 09/711,221

(22) Filed: Nov. 9, 2000

(51) Int. Cl.[7] ..... A47C 1/16
(52) U.S. Cl. ..... 297/352; 297/378.1
(58) Field of Search ..... 297/352, 378.1, 297/380, 381

(56) References Cited

U.S. PATENT DOCUMENTS

| | | | | | |
|---|---|---|---|---|---|
| 2,220,865 | A | | 11/1940 | Hines | |
| 2,509,420 | A | | 5/1950 | Burch | |
| 2,518,971 | A | * | 8/1950 | Zillig | 297/380 |
| 2,736,365 | A | * | 2/1956 | Hines | 297/352 |
| 2,738,169 | A | * | 3/1956 | Highley | 297/352 |
| 2,750,992 | A | * | 6/1956 | Decker | 297/380 |
| 2,957,515 | A | * | 10/1960 | Gibson | 297/378.1 |
| 3,026,142 | A | * | 3/1962 | Holloway | 297/352 |
| 3,066,980 | A | | 12/1962 | Clute | |
| 3,302,972 | A | * | 2/1967 | Lueders | 297/352 |
| 3,560,047 | A | | 2/1971 | Davis | |
| 3,994,529 | A | | 11/1976 | Lippert | |
| 4,715,652 | A | | 12/1987 | Ward | |
| 5,580,130 | A | | 12/1996 | Williams et al. | |

* cited by examiner

*Primary Examiner*—Peter R. Brown
(74) *Attorney, Agent, or Firm*—Roy, Kiesel, Keegan & DeNicola

(57) ABSTRACT

An improved foldable, portable stadium seat providing greater support, comfort, stability, and durability through the use of a forward, downward sloping cushioned seat formed in part by a stiff tubular frame having a U-shaped section and two vertically extending straight sections to which is pivoted mounted to a backrest frame of a backrest at a position permitting the backrest frame to contact the bleacher when the backrest is in its vertical most position.

7 Claims, 3 Drawing Sheets

STADIUM SEAT

A. BACKGROUND OF THE INVENTION

1. Field of the Invention

This invention relates in general to foldable, portable stadium seats attachable to a stadium bleacher.

2. Prior Art

Foldable, portable stadium seats are well known in the art. One of the most common comprises a seat member attached to a backrest member pivotly connected to fold against one another when not in use. These seats are attached to a stadium bleacher by a hook member held in position against the bleacher generally by a spring. Examples of such seats are illustrated in U.S. Pat. Nos. 2,220,865, 2,509,420, 2,736,365, 3,066,980, 3,560,047, 3,994,529, 4,715,652, and 5,580,130.

Although the prior art stadium seats to improve the comfort of the user, there remains a need for improved comfort and increased back support. In addition, these prior art stadium seats are prone to become unattached to the bleacher, particularly when a person pivots in the seat or leans back with too much force. This not only is a nuisance, but can also cause harm to the user in certain circumstances.

B. OBJECTS AND SUMMARY OF THE INVENTION

Therefore, one object of this invention is to provide an improved stadium seat that is comfortable and supportive of the person sitting in the seat.

Another object of this invention is to provide an improved stadium seat that is stable and less prone to become unattached to the stadium bleacher by the ordinary movements of a person sitting in the seat.

Still another object of this invention is to provide an improved stadium seat that will not mar or otherwise damage the bleacher through its use.

Other objects and advantages of this invention shall become apparent from the ensuing descriptions of the invention.

Accordingly, a conventional foldable, portable stadium seat having a backrest member pivotly mounted to a seat member attached to a stadium bleacher by one or more spring biased hook members, preferably at least two, is improved by using a forward, downward sloping cushioned seat mounted on a stiff tubular frame. In a preferred embodiment the seat comprises a stiff tubular frame to which the cushion is attached. A particularly preferred frame is one constructed from Schedule 40, one-inch aluminum tubing, or other tubing material having similar stiffness characteristics. In another preferred embodiment, the seat member further comprises a support panel positioned between the cushion and the frame. The support panel extends over the frame and is constructed of material having sufficient rigidity and strength to prevent the cushion from being pushed through the frame when a person sits on the cushion.

In an alternate improved embodiment of a stadium seat, the backrest assembly comprises a flexible backrest mounted on a tubular frame pivotly attached to the seat assembly frame at a position permitting the backrest frame to extent beneath the seat frame and to be placed in contact with the stadium bleacher when the backrest is in its most vertical position and the stadium seat has been affixed to the bleacher for use. Preferably in this embodiment the seat assembly frame comprises a U-shaped member whose two legs have at their extending ends two straight extensions, each extending upward at an angle from one of the legs. In this embodiment the backrest frame is pivotly attached to the seat frame straight extensions at a position permitting the backrest frame to extedn beneath the seat frame and in contact the bleacher during use. It is also preferred that one or more scratch or mar-preventing buffer members be fixed to the backrest frame at a position to directly contact the stadium bleacher when the stadium seat has been attached for use. The buffer members are shaped and constructed from material that will prevent the backrest assembly frame from scratching or otherwise marring the stadium bleacher during use. More preferably each of the buffer members will each be constructed from skid-resistant material, such as rubber or soft plastic.

C. BRIEF DESCRIPTION OF THE DRAWINGS

The accompanying drawings illustrate a preferred embodiment of this invention. However, it is to be understood that this embodiment is not intended to be exhaustive, nor limiting of the invention. The drawings illustrate only specific examples of the form in which the invention may be practiced. They are provided for the purpose of illustration in order that others skilled in the art may fully understand the invention, the principles thereof, and the manner of applying it in practical use so that they may modify and adapt it in various forms, each as may be best suited to the conditions of a particular use.

D. PREFERRED EMBODIMENTS OF THE INVENTION

Without any intent to limit the scope of this invention, reference is made to the figures in describing the preferred embodiments of the invention.

Figure 1:
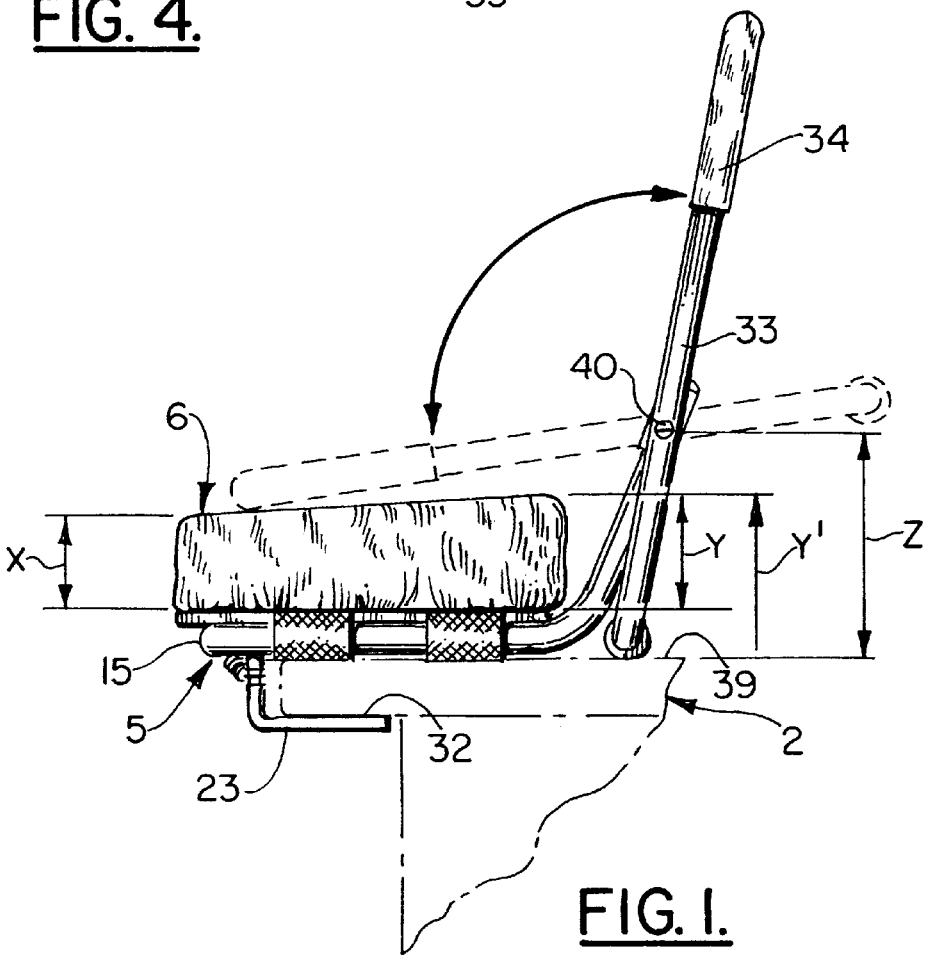
FIG. 1 is a side view of the invention illustrating the stadium seat attached to a conventional stadium bleacher in a position for use.

FIG. 1 illustrates a preferred embodiment of a stadium seat constructed in accordance with this invention. More particularly, stadium seat 1 is constructed for attachment to a conventional stadium bleacher 2, and comprises a seat assembly 3 attached to backrest assembly 4 in a manner permitting the backrest assembly 4 to be folded over seat assembly 3 as illustrated by the phantom lines in FIG. 1. In this folded over position cross tubing section 41 serves as a carrying handle for stadium seat 1. Additionally, the stadium seat 1 in this position is compact for easy storage.

Figure 4:
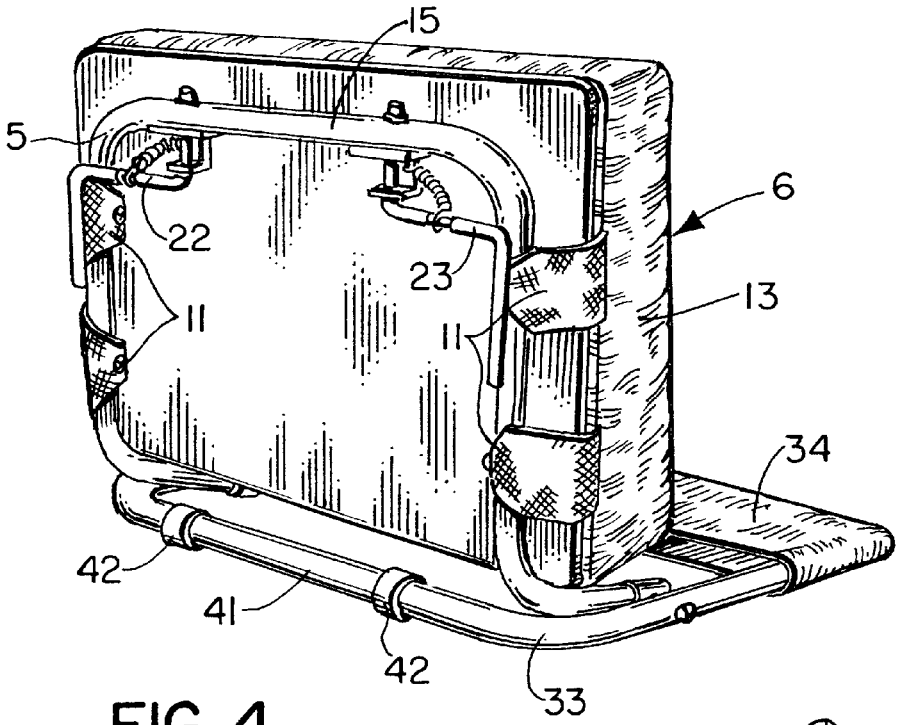
FIG. 4 is a three-dimensional view of the stadium seat illustrating its bottom side.

In a preferred embodiment the seat assembly 3 comprises a frame 5 to which is attached a cushion 6 whose front height "x" is less than its back height "y" (see FIG. 4). In a more preferred embodiment "x" will be about 2 inches and "y" will be about 3 inches. It has been found this configuration provides increased comfort and greater stability in maintaining the seat assembly 1 affixed to stadium bleacher 2, as well as allows the feet of an average height person to touch the bleacher floor when sitting in stadium seat 1. In another preferred embodiment frame 5 is constructed from schedule 40, one-inch aluminum tubing, or other tubing having at least similar strength and about the same flexibility.

Figure 2:
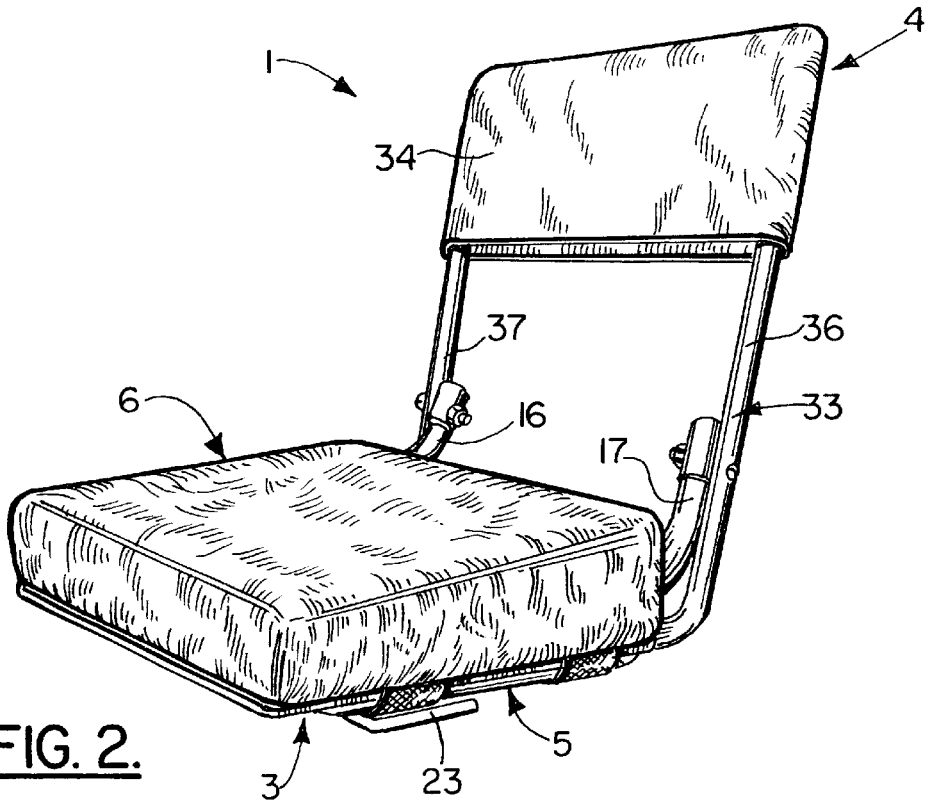
FIG. 2 is a three-dimensional, three-quarter, front view of the stadium seat illustrating the preferred forward, downward sloping top surface of the cushioned seat member.
Figure 3:
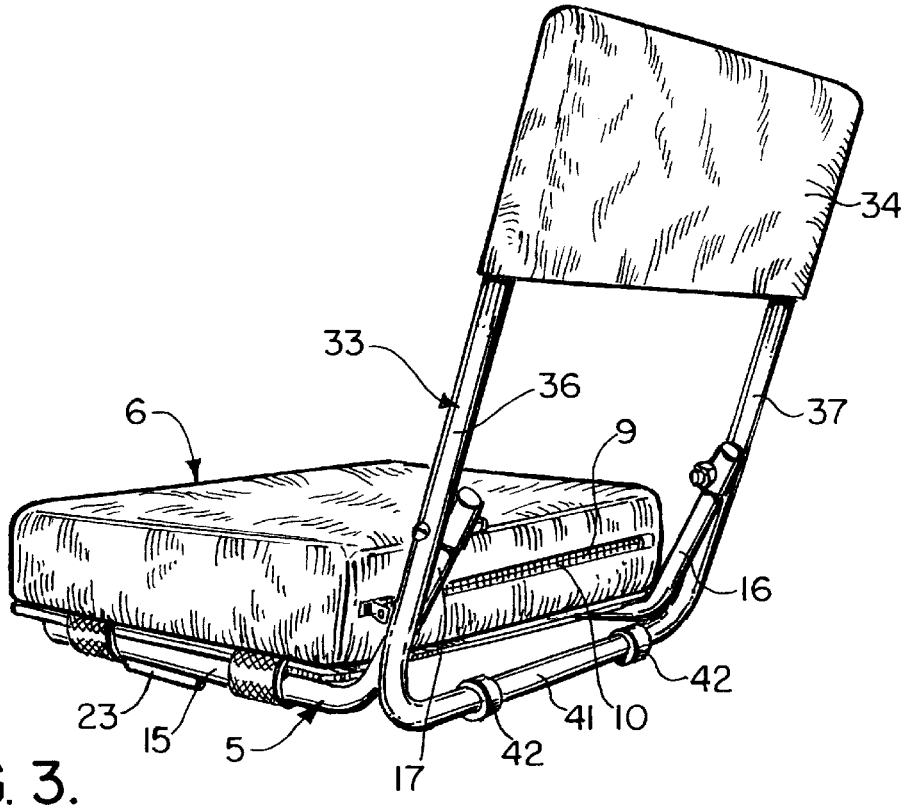
FIG. 3 is a three-dimensional, three-quarter, side view of the seat frame pivoted attachment to the backrest frame with other elements of the preferred embodiments.

In another preferred embodiment the cushion 6 will comprise a compressible member 7 that can be inserted in a protective covering 8. The compressible member 7 can be constructed of various known foam materials. The degree of compression can vary, but should support the weight of the use without fully compressed. It is also preferred that the foam material should be no thicker than about 4 inches. This height should in most cases not permit the user to be positioned in the seating position above the stadium bleacher 2 to obstruct the view from a person seating behind the user. It also in most cases not cause any difficulty in the feet of a user to be unable to contact the stadium floor. The protective covering 8 is preferably constructed of cloth to minimize sweating, but could be constructed from known plastics or other material having a similar characteristic. It is also preferred that protective covering 8 be constructed in a manner to allow its removal from the compressible member 7 in order to permit it to be washed. One manner is to provide an opening 9 (see FIG. 2) in the protective covering 8, preferably constructed from water-resistant fabric, through which the compressible member 7 can be inserted. If desired this opening can be closed by a conventional zipper 10, or similar known closure construction, such as a Velcro® hook-and-loop type construction.

Figure 5:
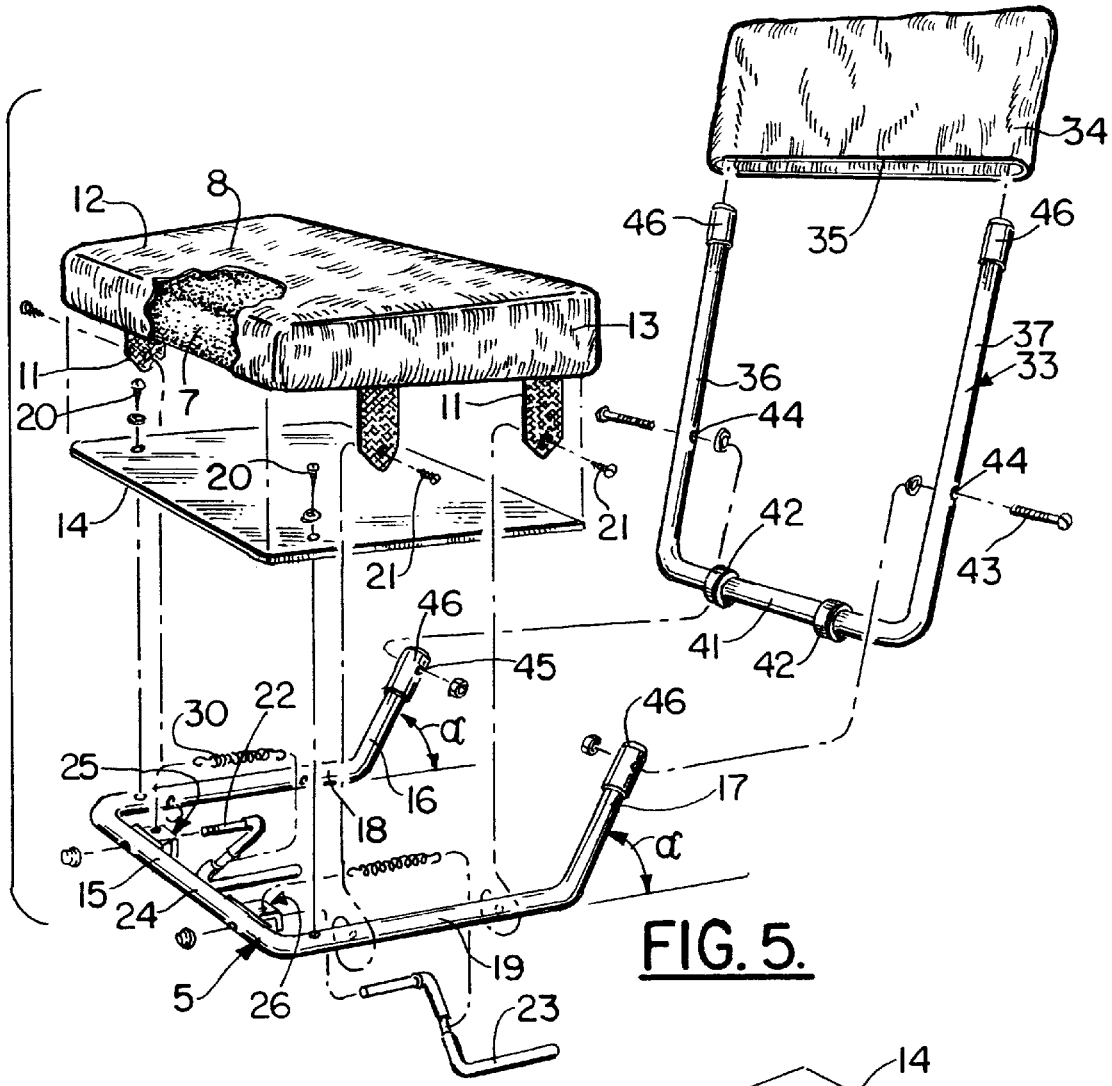
FIG. 5 is an exploded view of a preferred embodiment of the stadium seat.

In another preferred embodiment illustrated in FIGS. 4 and 5 cushion 6 will be secured to frame 5 by straps 11 fixed to both sides 12 and 13 of cushion 6. In a more preferred embodiment seat assembly 3 also comprises a support panel 14 positioned between frame 5 and cushion 6. Support panel 14 can be constructed of fiberboard, plastic, wood, metal sheeting, or such other material that will assist in supporting cushion 6 on frame 5. Support panel 14 should be of sufficient rigidity and strength to prevent cushion 6 from being pushed through frame 5 when a person sits on cushion 6.

In a most preferred embodiment illustrated in FIG. 5, frame 5 is constructed having a generally U-shaped section 15 and a pair of tubing extensions 16 and 17, each extending at an angle "alpha" from one of the legs 18 and 19 of U-shaped section 15. Support panel 14 is shaped and sized to fit over U-shaped section 14 and attached thereto by screws 20. In this embodiment is also preferred that straps 11 each be of a length to permit it to be wrapped about the tubing 18 or 19 and fixed thereto by screws 21. In an alternate embodiment Velcro® hook-and-loop material, or any other conventional attaching means can be used to connect cushion 6 and panel 14 to frame 5.

Figure 6:
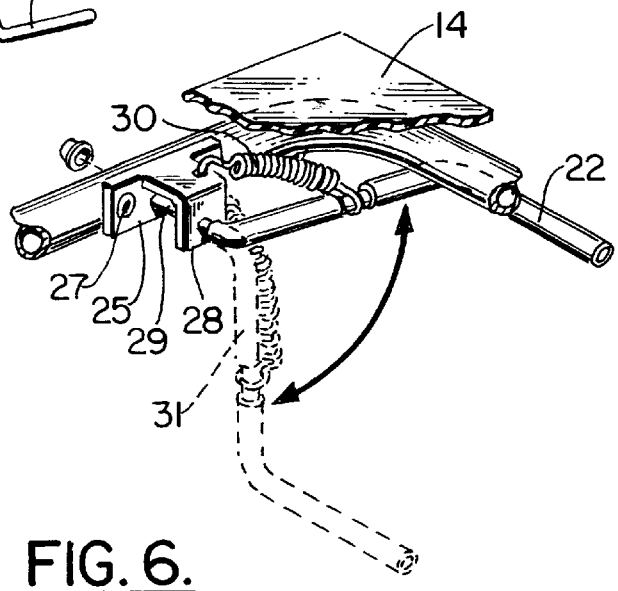
FIG. 6 is a three-dimensional view of the hooking members used to help secure the stadium seat to the bleacher.

In another preferred embodiment also illustrated in FIGS. 5 and 6, seat assembly 3 further comprises a pair of spring actuated hooking members 22 and 23 fixed to the front tubing 24 of U-shaped frame section 15. Hook members 22, 23 are fixed to front tubing 24 by connecting members 25, 26, respectively by bolts 27. Each connecting member 25, 26 has a U-shaped flange 28 provided with an opening through which pivot arm 29 of a hook member extends. A spring 30 is attached at its opposite ends to flange 28 and middle section 31 of a hooking member 22 or 23, respectively. With this construction, hooking members 22, 23 when moved down as illustrated by the phantom lines in FIG. 6 and will exert an upward force against the bottom surface 32 of bleacher seat 2. For increased stability and more secure attachment of stadium seat 1 to stadium bleacher 2 it is preferred that at least two hooking members be operatively attached to the front tubing 15.

In a preferred embodiment backseat assembly 4 comprises a U-shaped or rectangular tubing member 33 to which is attached a flexible back support panel 34. In one preferred embodiment panel 34 is constructed from cloth or other similar material to form a pocket 35 into which at least a portion of the upwardly extending legs 36, 37 of member 33 can extend.

In a preferred embodiment of backseat assembly 4 is pivotly attached to seat assembly 3 in a manner that causes lower cross tubing 38 of tubing member 33 to rest on top surface 39. This configuration results in greater stability of the stadium seat when it is being used. The increased stability decreases the likelihood that the stadium seat will become detached from the stadium bleachers 2 when a person moves about while seated or in the act of standing up from the stadium seat. It is further preferred that the pivot position 40 be located at a height "z" above the stadium bleacher 2 at least as great as the distance of the height "y" of cushion 6 from the stadium bleacher 2. One means to pivotly attach U-shaped member 33 to the tubing extensions 16 and 17 is through the use of bolts 43 that extend through aligned openings 44 and 45 of legs 36, 37 and extensions 16, 17 respectively.

In another preferred embodiment attached to a cross tubing section 41 is at least one bumper member 42. Bumper member 42 is preferably constructed from material that would not scratch or otherwise scar the stadium bleacher. It is also preferred that bumper member 42 be constructed of skid-preventing material. Examples of material from which bumper member 42 could be constructed would include plastic, rubber, or other similar material.

It is also preferred that U-shaped tubing member 33 be Schedule 40 aluminum pipe to optimize the desired stability and to maintain the stadium seat lightweight. It is also preferred that the ends of extensions 16, 17 and legs 36, 37 be capped by a protective member 46 to minimize the possibility of the ends scratching a person, the bleacher, or other object.

In use, the backseat assembly 4 is pivoted to its upright position that preferably is at a 75°–90° angle from bleacher 2. Next, the two hooking members 22, 23 are pivoted down sufficiently until the stadium bleacher can be and is fitted between the hooking members 22, 23 and U-shaped section 15. The hooking members 22, 23 are then released to permit spring 30 to bring the hooking members into contact with the lower surface of stadium seat 2. The stadium seat is now ready for use.

There are of course other alternate embodiments which are obvious from the foregoing descriptions of the invention which are intended to be included within the scope of the invention as defined by the following claims.

What I claim is:

1. A foldable, portable stadium seat for use on a section of a stadium bleacher designated for a person to sit, the stadium seat comprising:

a seat assembly comprising a seat assembly frame, said seat assembly configured to be attachable to the stadium bleacher, a cushion attached to said seat assembly frame, said cushion having front and rear sides, the front side being of less height than the rear side;

a support panel positioned between said seat member frame and said cushion, said support panel extending substantially over said seat member frame and constructed from material having sufficient rigidity and strength to prevent said seat member frame from being felt through said cushion by a person sitting on said cushion;

wherein said seat assembly frame further comprises:

i. a U-shaped section extending along the front and side perimeter of the bottom side perimeter of the bottom side of the support panel, ii. a first straight extension extending upward at an angle from one leg of the U-shaped section, and iii. a second straight extension extending upward at an angle from a second leg of the U-shaped section; and wherein said stadium seat further comprises a backrest assembly, said backrest assembly comprising a backrest affixed to a tubular backrest frame comprising a cross member and two substantially parallel legs forming a U-shaped frame, each of said legs being pivotally mounted to a straight extension of the seat member frame, said backrest frame configured to rotate in any position between the backrest assembly contacting the cushion and the backrest being vertically positioned at an angle in relation to the seat member, said backrest assembly configured to allow said cross member to contact the stadium bleacher when the backrest is in its most vertical position.

2. A stadium seat according to claim 1 wherein the backrest assembly further comprises rings fixed to the exterior of the backrest member frame at a position between the backrest frame and the stadium bleacher to prevent the backrest frame from direct contact with the stadium bleacher.

3. A stadium seat according to claim 1 wherein said cushion comprises a fabric sack forming an interior cavity housing a foam insert having front and rear sides, the front side being of less height than the rear side.

4. A stadium seat according to claim 1 further comprising at least two attaching members affixed to the seat member frame, each having an L-shaped section configured to extend under the stadium bleacher and be held in contact with the stadium bleacher by a spring affixed to the seat assembly frame at one end and to the L-shaped section at its other end.

5. A stadium seat according to claim 1 wherein the frame is constructed from Schedule 40, one inch aluminum tubing.

6. A foldable, portable stadium seat for use on a section of a stadium bleacher designated for a person to sit, the stadium seat comprising:

a seat assembly comprising a seat assembly frame, said seat assembly configured to be attachable to the stadium bleacher, a cushion attached to said seat assembly frame, said cushion having front and rear sides, the front side being of less height than the rear side;

a support panel positioned between said seat member frame and said cushion, said support panel extending substantially over said seat member frame and constructed from material having sufficient rigidity and strength to prevent said seat member frame from being felt through said cushion by a person sitting on said cushion;

wherein said seat assembly frame further comprises:

i. a U-shaped section extending along the front and side perimeter of the bottom side perimeter of the bottom side of the support panel, ii. a first straight extension extending upward at an angle from one leg of the U-shaped section, and iii. a second straight extension extending upward at an angle from a second leg of the U-shaped section; and wherein said stadium seat further comprises a backrest assembly, said backrest assembly comprising a backrest affixed to a tubular backrest frame pivotally mounted to both straight extensions of the seat member frame, said backrest frame configured to rotate in any position between the backrest assembly contacting the cushion and the backrest being vertically positioned at an angle in relation to the seat member.

7. A stadium seat according to claim 6 wherein the frame is constructed from Schedule 40, one inch aluminum tubing.

* * * * *